United States Patent [19]

Brewer

[11] 3,951,266

[45] Apr. 20, 1976

[54] THIN WALLED CUP

[75] Inventor: Clarence T. Brewer, Oak Park, Ill.

[73] Assignee: Solo Cup Company, Urbana, Ill.

[22] Filed: June 21, 1974

[21] Appl. No.: 481,506

[52] U.S. Cl. ..... 206/520; 229/1.5 B
[51] Int. Cl.[2] ..... B65D 21/02; B65D 1/46
[58] Field of Search ..... 206/519, 520; 229/1.5 B

[56] References Cited

UNITED STATES PATENTS

| | | | |
|---|---|---|---|
| 2,288,602 | 7/1942 | Benton | 206/520 |
| 2,859,557 | 11/1958 | Cattuca | 229/1.5 B |
| 2,988,258 | 6/1961 | Witzke | 206/520 |
| 3,443,714 | 5/1969 | Edwards | 206/520 |
| 3,484,018 | 12/1969 | Davis | 206/520 |
| 3,653,575 | 4/1972 | Schrepper | 206/520 |

*Primary Examiner*—George E. Lowrance
*Attorney, Agent, or Firm*—Fitch, Even, Tabin & Luedeka

[57] ABSTRACT

An expendable thin walled cup for liquids and the like is disclosed having a configuration which facilitates improved removal from the forming mold, insures more uniform wall thickness and prevents telescoping of the spacing means of a plurality of the cups when stacked in nested relation.

6 Claims, 6 Drawing Figures

FIG. 1
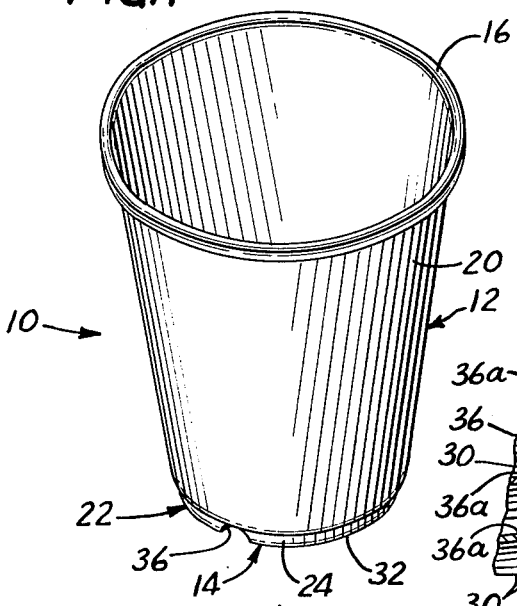
FIG. 5
FIG. 3
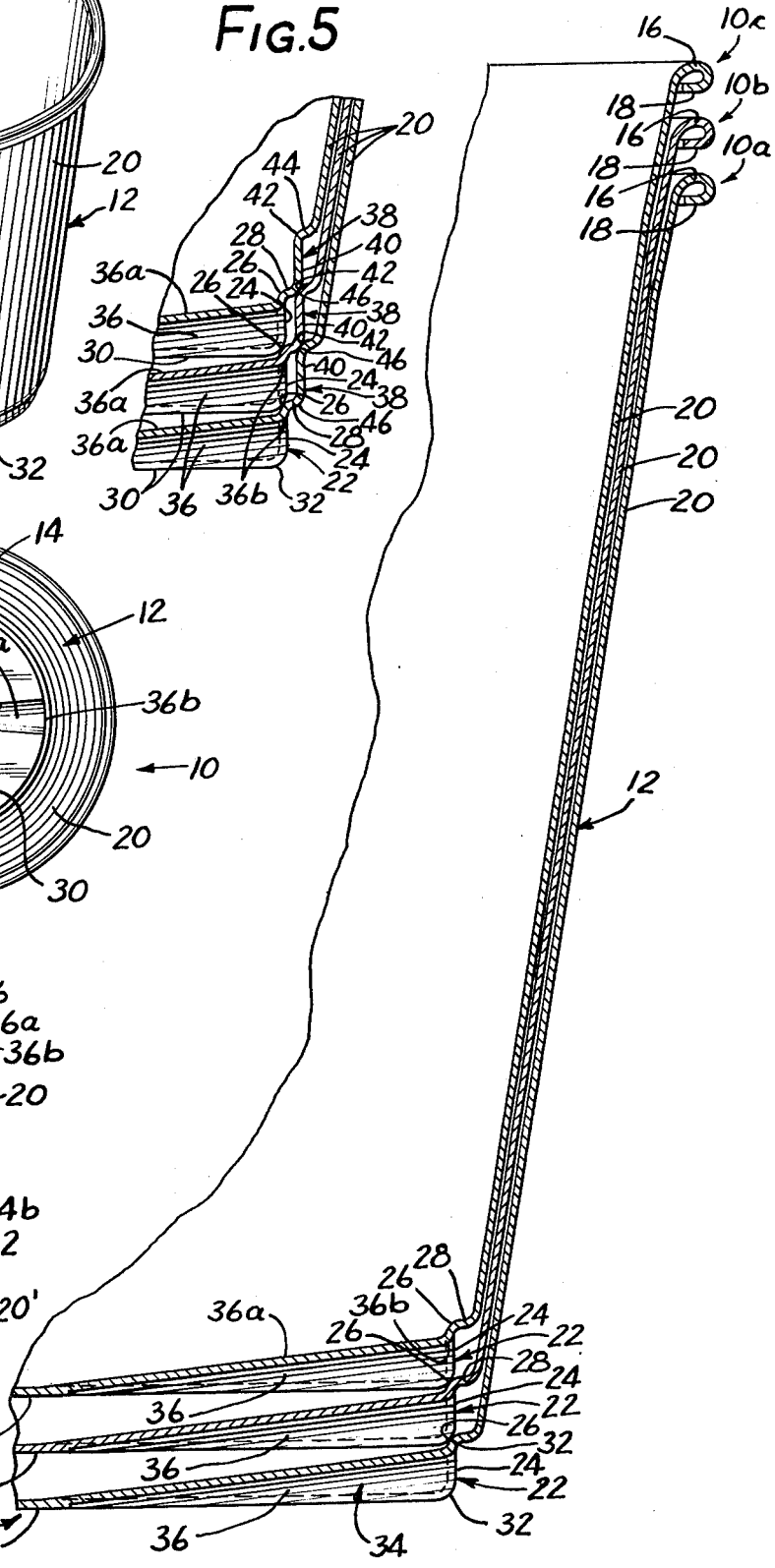
FIG. 2
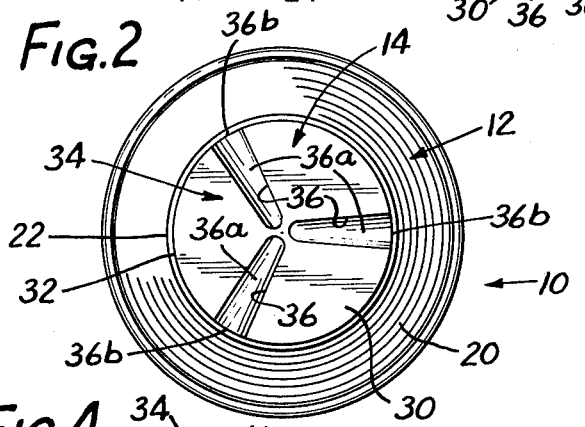
FIG. 4
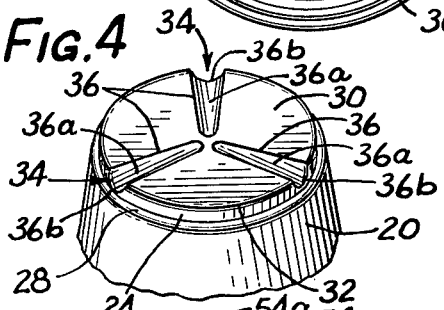
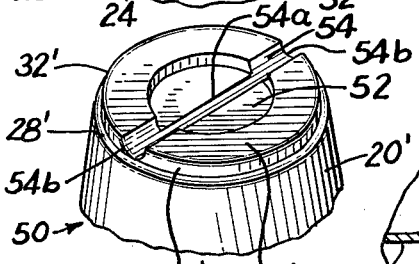
FIG. 6

THIN WALLED CUP

The present invention relates generally to thin walled containers or cups of the expendable type for receiving cold or hot liquids, such as consumer beverages and the like, and more praticularly to a container or cup of the frustoconical nesting type having a novel construction which facilitates removal from a forming mold and prevents telescoping of the spacing means and wedging or sticking of two or more nested cups whereby to allow the cups to be readily separated when removing a cup from a nested stack thereof.

The use of thin walled nestable cups for use with hot and cold beverages and the like has become increasingly prevalent both in commercial use, such as in public facilities, and in the home. Such cups or containers when presented in nested stacked relation lend themselves to use with supporting and dispensing fixtures which allow a plurality of the cups to be stored in a relatively compact manner and which facilitate withdrawal or removal of a single cup from the nested stack for a single use whereafter the cup may be disposed of. Such single usage eliminates spreading of contagious matter as frequently results from multiple use of cups and containers.

A problem in the use of thin walled cups is their susceptibility to being jammed together, resulting in wedging or sticking wherein the peripheral side walls of adjacent cups in a stack of nested cups are in substantially full surface engagement which inhibits individual separation of the stacked cups for use. In the early development of expendable thin walled cups, the cups were generally made of a paper material which was formed into a desired frustoconical cup configuration and glued. To prevent wedging or sticking together, each cup was formed with a bottom floor inset positioned a predetermined distance up from the bottom margin or edge of the peripheral side wall, forming a recessed volume under the bottom floor of the cup defined as a false bottom. The bottom floor is located upwardly from the bottom margin or edge of the cup to provide a stop or seat for the next above nested cup to rest on, and to maintain a spaced relation and freedom between the peripheral adjacent side walls of the nested cups, thereby facilitating separation of the nested cups.

The advent of injection molded cups introduced the concept of molding cups in one piece, simulating the conventional two-piece paper cup. Also, the concept provided each cup with a nest-spacing means formed by thickening the peripheral wall of the cup for a short distance above the bottom floor so as to establish an inwardly directed ledge or shoulder stop to support the bottom margin of the side wall of the next above nested cup. The nest-spacing means serve to maintain the side walls of adjacent nested cups in a stack in sufficiently spaced relation to facilitate separation of the cups from their nested relation. The nest-spacing means is normally made of sufficient ledge or shoulder-stop width that telescoping of the nest-spacing means is prevented even when the stack of cups is dropped during shipping and handling. In injection molding or plastic molding, sharply defined edges can easily be consistently produced, whereas in thermoforming even the sharpest bends are slightly rounded on the outside of the bend.

More recent developments in thin walled container cups which are adapted for stacking in nested relation have introduced what is generally termed the thermoformed cup. The thermoformed cup generally has a wall thickness of approximately 0.010 inch. In the preliminary design and development of the thermoformed cup, it was initially believed that if a thin walled cup having an outwardly tapered upper side wall was provided with nest-spacing means in the form of a right-cylindrical side wall portion to establish a generally transversely disposed ledge or shoulder interconnecting the tapered and right-cylindrical side wall portions, the cups when stacked in nested relation would not telescope in the nest-spacing means area. However, in actual practice it was found that such cups did telescope to the extent that the right-cylindrical side wall portions of one or more cups in a stack of nested cups would telescope downwardly within the corresponding wall portion of the next below cup, particularly when a stack of nested cups was dropped or otherwise subjected to a force tending to axially compress the cups into each other. As a consequence of such telescoping, withdrawal or removal of one cup from the remaining stack of nested cups was difficult if not impossible without having to manually retain the next above or below cup in the stack, depending upon whether the cups were in an upright or inverted position when separating them. Telescoping of the thermoformed cups made with a nest-spacing means in the form of right-cylindrical lower side wall configurations resulted from the fact that the thin side walls did not provide sufficient support or interference surface area for a positive stop-spacing ledge or shoulder in the nest cup to prevent the nested cup from telescoping past the stop downwardly within the nest-spacing means of the next below cup in the stack.

In an attempt to eliminate the aforenoted problem of telescoping of the thin-walled thermoformed cups, the lower portions of the peripheral side walls of the thin walled cups were formed adjacent their bottom floor with an inward or reversed tapered side wall. With such an inward tapered configuration, the lower margin of the side wall had a substantially greater outer diameter than the inner diameter of the upper generally radial shoulder portion of the nest-spacing means. The lower margin of the side wall would thus rest upon the upper smaller diameter shoulder of the nest-spacing means of the next below cup within a nested stack of cups, thereby preventing telescoping and facilitating separation of the cups from the nested stack. It has been found that the employment of nest-spacing means in the form of inward or reverse tapered side wall configurations, while preventing telescoping and facilitating separation of nested cups, has substantially increased production costs primarily as a result of difficulty in conforming the lower margin of the side wall against the lower annular edge surface of the female mold in which the thermoformed cups are conventionally formed. Additionally, the thickness of the cup wall at the intersection of the lower margin of the side wall with the bottom floor has frequently been found to be nonuniform with resulting thin wall sections which lead to fracture either during removal from the female mold or during subsequent handling and shipment, all with the result that leakage is encountered during use of such cups. In employing the inward or reverse tapered side wall configurations, the inside diameter of the spacing ledge or shoulder-forming ring of the mold is smaller than the outside diameter of the bottom of the cup. This produces interference when stripping from the mold, making it necessary to deflectively distort the lower margins of the cups which in turn makes it difficult to remove cups from their molds after thermoforming, resulting in increased cost of manufacture.

In striving to overcome the disadvantages found in the prior art thin walled thermoformed cups, and particularly the disadvantages presented by the noted inward tapered side wall nest-spacing means, a cup having nest-stacking means in the form of a right-cylindrical lower side wall will be substantially more economical to produce through the elimination of the problems encountered in forming nest-spacing means in the form of an inward tapered side wall. In analyzing the heretofore encountered problem of telescoping with thin walled thermoformed cups having right-cylindrical lower peripheral wall portions, it was found that when the lower portion of a cup side wall is formed into a right-cylindrical configuration, the maximum effective spacing stop-ledge or shoulder area is limited to the thickness of the side wall of the right cylinder portion of the cup. The outside bottom edge of the cup is, by the nature of the forming operation, slightly rounded, and the inside edge of the spacing stop-ledge is also, by nature of the forming operation, slightly rounded. Therefore, when cups are in a nested stack and the bottom edge of the nested cup is seated in spaced position in the nest cup, the two opposite rounded peripheral edges tend to guide telescoping of the nest-spacing means if enough force is applied to deform them, that is, to expand the nest cup spacing means diameter and/or compress the nested cup bottom diameter such as when a stack of the nested cups is dropped on end or otherwise subjected to an axial compression force.

The present invention overcomes the disadvantages experienced in the prior art container cups by providing a novel thin walled expendable cup which is readily removable from the female mold after forming and which prevents telescoping with one or more similar cups when stacked in nested relation therewith.

Accordingly, one of the primary objects of the present invention is to provide a new and improved thin walled cup having a novel lower side wall and bottom floor configuration which provides a positive nest-spacing means and prevents telescoping of such cups when stacked in nested relation whereby to facilitate ease of separation of the stacked cups.

Another object of the present invention is to provide a novel thin walled cup construction wherein the lower portion of the cup side wall is formed with nest-spacing means in the form of a right-cylindrical wall and adjacent stop-shoulder configuration to facilitate removal from the forming mold; and wherein the bottom floor incorporates a configuration forming a gusset between the bottom floor and the right cylindrical side wall and adjacent stop-shoulder to strengthen the right cylindrical wall against diametrical extension or compression and add positive support for the adjacent stop-shoulder whereby telescoping of one or more cups is prevented.

A feature of the present invention lies in the provision of gussets in the form of selective depressions provided in the bottom floor of the cup to prevent warping of the bottom floor and also to prevent such inward deformation of the lower right-cylindrical side wall portion of the cup as would allow telescoping of adjacent cups in a stack of nested cups.

Another feature of the present invention lies in the ability of the gusset depressions to provide breathing passages for air to pass between the stop-shoulder or ledge of the nest cup and the bottom of the nested cup whereby to prevent air lock which would impede the separation of nested cups.

In accordance with the present invention, the depressions or flutes formed in the bottom floor of the cup may be generally radially-disposed and serve to provide added inward stop support to the peripheral stop-shoulder disposed at the upper edge of the right-cylindrical side wall.

An optional feature of the present invention lies in the provision of doulbe nest-spacing means on each cup in the form of a pair of axially adjacent right-cylindrical peripheral wall portions and associated adjacent stop-shoulder surfaces.

Further objects and advantages of the present invention, together with the organization and manner of operation thereof, will become apparent from the following detailed description of the invention when taken in conjuction with the accompanying drawings wherein like reference numerals designate like elements throughout the several views, and wherein:

FIG. 1 is a perspective view of a thin walled expendable cup constructed in accordance with the present invention;

FIG. 2 is a bottom view of the cup illustrated in FIG. 1;

FIG. 3 is an enlarged partial longitudinal sectional view showing a plurality of the cups in accordance with the present invention in stacked-nested-spaced relation;

FIG. 4 is a partial perspective view showing the bottom of the cup of FIG. 1;

FIG. 5 is an enlarged partial sectional view illustrating an alternative embodiment of cups in accordance with the present invention, with each cup having double nest-spacing means thereon; and FIG. 6 is a partial perspective view similar to FIG. 4 but showing a further embodiment of a cup in accordance with the present invention.

Referring to the drawings, and in particular to FIGS. 1–4, a cup or container constructed in accordance with one embodiment of the present invention is indicated generally at 10. The cup 10 is of the thin walled expendable type adapted to be stacked in nested relation with a plurality of similarly shaped cups. The cup 10 is formed of a plastic material suitable for use with hot or cold liquids and finds application in both commercial use and in the home.

More specifically, the cup 10 is formed from a thin, flexible plastic material in a one-piece seamless construction, preferably by thermoforming a suitable plastic material such as polystyrene, it being understood that other materials may also be used for the cup 10 within the purview of the present invention.

The cup 10 is conventionally termed a "thin walled" cup in that its wall thickness is generally approximately 0.010 inch. The wall thickness is substantially uniform throughout the cup 10 which is formed so as to be symmetrical about a longitudinal axis extending through the center of the cup. The cup 10 includes a peripheral side wall, indicated generally at 12, and a bottom floor, indicated generally at 14, formed integral with the peripheral side wall 12 so as to form a liquid receiving receptacle open at its upper end. The upper end of the peripheral side wall 12 terminates in an annular rim 16 created by forming the upper edge of the upstanding side wall 12 to establish an underturned and inwardly directed wall portion 18, as best seen in

FIG. 3.

In accordance with the embodiment illustrated in FIGS. 1–4, the peripheral side wall 12 includes an upper peripheral side wall portion 20 and lower nest-spacing means, indicated generally at 22, which includes a right-cylindrical peripheral wall portion 24 and an annular stop-shoulder 26 formed integral with and adjacent the upper end of the right-cylindrical wall portion 24. The upper side wall portion 20 tapers generally uniformly outwardly from the longitudinal axis of the cup 10, considered in an upward direction from the lower nest-spacing means 22, such that the upper side wall 20 forms a generally frustoconical configuration. As considered in FIG. 3, the stop-shoulder 26 comprises an annular seat defined by the intersection of a generally transverse ledge 28 with the upper end of the right-cylindrical wall portion 24, the ledge 28 also being formed integral with the lower edge of the upper outwardly tapered side wall portion 20.

The bottom floor 14 of the cup 10 includes a generally circular floor 30 which, in the embodiment of FIGS. 1–4, is defined as being generally planar and lying in a plane normal to the longitudinal axis of the cup 10. In practice, the bottom floor 30 may be made slightly concave, such as by forming the bottom floor with a shallow upwardly directed conical central surface, so that the cup rests on an annular marginal support area of the floor. In this manner, the right-cylindrical peripheral side wall portion 24 of the nest-spacing means 22 is generally perpendicular to the plane of the bottom floor 30. A peripheral edge surface or margin 32 of a relatively small radius is formed at the lower edge of the peripheral right-cylindrical wall portion 24.

By way of example only, a cup of approximately 3 oz. capacity may have a diameter at its upper end or rim 16 of approximately 2 7/16 inches and a diameter within the plane of the bottom floor 14 of approximately 1½ inches. For such a cup, the overall vertical height of the cup is approximately 2¼ inches, while the vertical height of the right-cylindrical peripheral wall portion 24 is approximately 3/32 inch. The transverse ledge wall 28 has a radial or transverse dimension of approximately 1/32 inch.

As best seen in FIG. 3, a plurality of the cups 10 are adapted to be stacked in nested relation. When a cup, such as indicated at **10*b*, is placed within a similar upstanding cup, such as indicated at 10*a*, the lower annular peripheral margin 32 on the cup 10*b* will engage the upper stop-shoulder 26 of the lower container cup 10*a*. Similarly, placing a cup 10*c* within the cup 10*b* will effect engagement of the bottom peripheral margin 32 on the cup 10*c* with the upper stop-shoulder 26 on the cup 10*b***.

Such intercooperation of the peripheral bottom margins 32 with the stop-shoulders 26 of the nested cups would normally be expected to effect sufficient interference to maintain the peripheral tapered side walls 20 of the container cups 10 in spaced relation so as to facilitate easy separation of the cups. However, as noted above, it has been found that when a stack of cups of the construction thus far described is dropped or otherwise subjected to an axial force, the generally planar bottom floor 30 of one or more of the cups may undergo a slight deforming or warping which tends to draw the associated annular margin 32 radially inwardly with the result that the lower annular margin 32 of the cup having the deformed or warped bottom floor will establish a diameter smaller than the inner diameter of the upper stop-shoulder 26 of the next below cup. This may further result in the lower right-cylindrical peripheral walls 24 of two or more adjacent cups, such as **10*a* and 10*b***, telescoping sufficiently to inhibit separation of the cups.

In accordance with the present invention, the bottom floor 30 of the cup 10 is provided with reinforcing means, indicated generally at 34, which prevents such deforming or warping of the bottom floor 30 from its general planar configuration if the cup should be subjected to a force which would tend to deform the bottom floor 30 when the cup is stacked in nested relation with similar cups. The reinforcing means 34 comprises a plurality of reinforcing gussets in the form of flutes or depressions 36 which are formed upwardly from the plane of the bottom floor 30. In the embodiment of FIGS. 1–4, three such flutes or depressions 36 are formed in the bottom floor 30 of the cup 10. The flutes 36 are generally radially disposed and are angularly spaced about the center axis of the circular bottom floor 30. In the embodiment illustrated in FIGS. 2 and 4, the flutes 36 are equally angularly spaced about the center axis of the floor 30 and extend from substantially the center of the circular bottom floor 30 radially outwardly to intersect the right-cylindrical wall 24. Each of the flutes or depressions 36 may take the form of a segment of a conical surface disposed such that, when considered in longitudinal section as in FIG. 3, a depressed surface **36*a* is formed which tapers upwardly and outwardly relative to the plane of the bottom floor 30. Preferably, each flute 36 has a cross sectional configuration, considered transverse to the major axis of the flute, which is generally oval. It will be understood that the reinforcing gussets or depressions 36** may be given substantially any desired shaped, and the number of gussets may be varied as desired to accomplish the intended reinforcing function.

The reinforcing gussets in the form of the flutes 36 having depressed surfaces **36*a* serve to increase the stiffness or rigidity of the associated floor 30 of the cup 10 and prevent the floor from warping or otherwise deforming from its normal generally planar shape when the cup 10 is subjected to shock forces acting generally normal to the plane of the floor 30. The depressed flute surfaces 36*a* intersect the right-cylindrical wall 24 to preferably establish generally oval edges 36*b* which prevent inward deforming of the right-cylindrical wall 24 and the adjacent annular stop-shoulder 26. The flutes or depressions 36 are formed so that the edges 36*b* are close to the associated stop-shoulder 26 but not so close that the wall 36*a* of the flute rises above the plane of the ledge 28** in a manner which would allow ratcheting of the flutes of adjacent cups in a stack.

The gusset depressions 36 need not be angularly equidistantly spaced about the axis of the cup 10 but may be unequally spaced. The gusset flutes in two or more cups may have different angular spacings. Additionally, the gusset flutes 36 need not necessarily be radially disposed within the floor 30 of a cup 10 as long as one or more flutes are provided which extend from the right-cylindrical wall 24 inwardly along the floor sufficiently to provide the desired gusseting strength.

By causing each of the flutes 36 in the floor 30 of a cup 10 to intersect the associated right-cylindrical wall 24 and establish the edges **36*b*, the marginal edge 32 is interrupted. Openings are thus provided by the arcuate edges 36*b* between the annular marginal edge 32 and the annular stop-shoulder 26** of the next below cup.

These openings allow air to enter the spaces created between the spaced floors 30 of the stacked cups and thereby prevent the formation of air locks which would hinder separation of the cups.

FIG. 5 partially illustrates an alternative embodiment of the cup 10 in accordance with the present invention, the difference in the embodiment of FIG. 5 and the embodiment illustrated in FIGS. 1–4 being in the nest-spacing means arrangement. In the embodiment illustrated in FIG. 5, wherein a plurality of cups are partially illustrated in nested relation, the elements common to the embodiment of FIGS. 1–4 are indicated by like reference numerals. Each of the cups 10 in accordance with the embodiment of FIG. 5 has a cascade spacing means taking the form of a plurality of nest-spacing means generally similar to the nest-spacing means 22 of the embodiment of FIGS. 1–4. The cascade spacing means of the embodiment illustrated in FIG. 5 takes the form of a lower nest-spacing means 22 and an upper nest-spacing means, indicated generally at 38. The lower nest-spacing means 22 takes generally the same form as the aforedescribed right-cylindrical wall portion 24 and adjacent stop-shoulder 26, while the second nest-spacing means 38 takes the form of a second or upper right-cylindrical peripheral wall portion 40 and an upper adjacent annular stop-shoulder 42. The right-cylindrical wall 40 is disposed in axially aligned adjacent relation to the lower right-cylindrical side wall 24. The stop-shoulder 26 comprises an annular seat defined by the intersection of a transversely disposed ledge 28 with the upper edge of the peripheral wall 22. The ledge 28 is also integral with the lower edge of the right-cylindrical peripheral wall 40. The stop-shoulder 42 comprises an annular seat defined by the intersection of a transversely disposed ledge 44 with the upper edge of the upper right-cylindrical peripheral wall 40. The ledge 44 is also formed integral with the lower edge of the associated tapered upper peripheral wall 20 of the cup 10. The right-cylindrical peripheral walls 22 and 40 are of equal vertical height.

Each of the cups 10 in accordance with the embodiment partially illustrated in FIG. 5 includes a generally planar bottom floor 30 having reinforcing means in the form of generally radially disposed gusset flutes or depressions 36 formed therein to provide rigidity for the bottom floor 30 and prevent inward deforming of the lower right-cylindrical wall 22 and adjacent stop-shoulder 26 in similar fashion to the above described embodiment of FIGS. 1–4. When a plurality of the cups 10 each having a cascade spacing means in the form of two or more nest-spacing means, such as 22 and 38 in FIG. 5, are assembled in stacked nested relation, the outer peripheral margin 32 of each cup in the stack engages the first stop-shoulder 26 of the next below container cup, while an outer peripheral margin 46 of each cup, established by the intersection of the ledge 28 with the upper edge of the right-cylindrical wall 24, engages the upper stop-shoulder 42 on the next below cup in the stack. Thus, in accordance with the cup illustrated in FIG. 5, two stop-shoulders in the form of annular seats 26 and 42 on each cup serve to support two margins 32 and 46 on the next above cup in a stack of nested cups whereby to maintain the cups in sufficient axial spaced relation that both their bottom floors 30 and peripheral tapered side walls 20 are maintained in spaced relation to facilitate separation or removal of a cup from the stack. The intersections of the flutes or depressions 36 with the right-cylindrical wall 22 form interrupted margin edges 32 to allow air entry between the floors 30 of adjacent stacked cups to prevent air lock and thereby facilitate separation of the stacked cups.

FIG. 6 illustrates still another embodiment of a cup, indicated generally at 50, constructed in accordance with the present invention. The cup 50 includes a peripheral tapered wall 20′ terminating at its lower end in a transverse ledge 28′ which, in turn, is formed integral with a right-cylindrical wall 24′. The right-cylindrical wall 24′ is formed integral with a bottom floor 30′ and establishes a margin edge 32′ therewith. The floor 30′ has a generally circular recess 52 formed centrally therein. The recess 52 provides a recessed surface upon which data, such as product number, source, etc., may be imprinted or embossed.

The cup 50 includes reinforcing means for the floor 30′ in the form of a single gusset defined by a flute or depression 54. The flute 54 is formed in the floor 30′ and extends across a diameter thereof to intersect the right-cylindrical wall 24′ and establish edges **54*b* which prevent inward deforming of the right-cylindrical wall 24′ and adjacent stop-shoulder (not shown in FIG. 6 but indentical to the stop-shoulder 26 of FIG. 3). The gusset or flute 54 extends below the plane of the recess 52 as indicated at 54*a* to reinforce the recessed surface 52**.

The floor 30 of the cup 10 and/or the floor 30′ of the cup 50 may be recessed or relieved so that the peripheral portion of the bottom floor projects below the central portion of the cup floor, considered with the cup in a normal upstanding position. This avoids the possibility of the bottom floor of a cup being formed slightly convex rather than flat or concave, and/or diaphragming due to manufacturing tolerances, considered when viewing the cup from its bottom or floor end, whereby to prevent the cup from pivoting or tilting on the central area of its floor when set on a planar surface.

In accordance with the described embodiments of the cups 10 and 50 of the present invention, significant advantages are provided over thin walled thermoformed container cups employing a reverse tapered stacking means configuration. The provision of the lower right-cylindrical peripheral wall portions, such as 24 in the embodiment of FIGS. 1–4, 24 and 40 in the embodiment illustrated in FIG. 5, and 24′ in the embodiment of FIG. 6, facilitate forming of the cups by eliminating the problems heretofore encountered in forming the reverse tapered side wall portions against the inner peripheral surface of the female forming mold, insure substantially uniform wall thickness throughout the cup wall so as to preclude possible fracture and attendant leakage, and substantially improve the ease with which the cups 10 may be removed from the associated forming mold.

Additionally, the cups 10 in accordance with the present invention have overcome the problems heretofore encountered in thin walled thermoformed container cups having nest-spacing means in the form of right-cylindrical lower peripheral side walls by providing reinforcing means within the bottom floor of each cup in the form of gussets which add rigidity to and prevent warping of the bottom floor and prevent inward deforming of the right-cylindrical wall portions and adjacent annular stop-shoulders in a manner which would allow telescoping of the right-cylindrical wall portions as above described.

While preferred embodiments of the present invention have been illustrated and described, it will be obvious to those skilled in the art that changes and modifications may be made therein without departing from the invention in its broader aspects. Various features of the present invention are defined in the following claims.

What is claimed is:

1. A thin walled cup including a peripheral side wall open at its upper end and closed at its lower end by a bottom floor, said peripheral side wall having an upper tapered wall portion and a right-cylindrical wall portion terminating at its lower edge in said bottom floor, said peripheral side wall defining an internal stop-shoulder means between said tapered and right-cylindrical wall portions and defining external lower margin means at said lower edge of said right-cylindrical wall portion, said internal stop-shoulder means being adapted to support the lower margin means of a similar cup when disposed in nested relation therewith so as to maintain the tapered peripheral side wall portions of the nested cups in spaced relation, said bottom floor including reinforcing means comprising at least one upwardly directed depression formed in said bottom floor and defining intersecting edges with said bottom floor and with said right-cylindrical side wall portion, said intersecting edge in said right-cylindrical side wall being in close proximity to said internal stop-shoulder means, said depression and associated intersecting edges with said bottom floor and said right-cylindrical wall portion substantially preventing deforming of said bottom floor and said right-cylindrical side wall portion in a manner which would allow telescoping of two or more of said cups when disposed in nested relation.

2. A cup as defined in claim 1 wherein said bottom floor has three of said upwardly directed depressions formed therein, said depressions extending radially and being angularly spaced about said bottom floor, considered relative to the center of said bottom floor in the general plane thereof.

3. A cup as defined in claim 1 including first and second right-cylindrical peripheral side wall portions formed adjacent said bottom floor of said cup, said first and second right-cylindrical wall portions establishing a pair of axially spaced internal stop-shoulders and a pair of axially spaced external margins, said external margins being engageable with the internal stop-shoulders of a similarly shaped cup when stacked in nested relation therein to maintain the tapered peripheral side walls of the nested cups in spaced relation, said depression formed in said bottom floor intersecting the lower of said first and second right-cylindrical peripheral side wall portions, when considered with the cup in a generally upright position.

4. A cup as defined in claim 3 wherein said first and second right-cylindrical peripheral surface portions have substantially equal longitudinal lengths.

5. A cup as defined in claim 1 wherein said internal stop-shoulder means is defined by an annular generally transversely disposed ledge formed between the upper edge of said right-cylindrical wall portion and the lower edge of said upper tapered peripheral side wall portion, said lower margin means being defined by an annular lower margin of said right-cylindrical wall portion such that said margin is adapted to engage the stop-shoulder of a similar cup when in nested relation therein.

6. A cup for receiving cold or hot liquid beverages and the like comprising a relatively thin walled body having an upstanding peripheral side wall and a bottom floor formed integral with said side wall to define a liquid receiving receptacle, said peripheral side wall having an outwardly tapered upper wall portion and a generally right-cylindrical lower wall portion, said right-cylindrical lower wall portion having an outer peripheral margin and defining with said upper tapered wall portion an internal stop-shoulder adapted to receive and support at least the outer peripheral margin of a second similarly configured cup when stacked in nested relation therewith, said bottom floor having reinforcing means formed therein by depressing a portion of said bottom floor toward the interior of said cup, said depressed floor portion defining intersecting edges with said bottom floor and intersecting said right-cylindrical wall portion to define an intersecting edge therein adjacent said internal stop-shoulder so that deforming of said floor and right-cylindrical wall portion in a manner which would allow telescoping of the deformed cup within a similar underlying cup when nested therewith is substantially prevented.

* * * * *